US008070537B2

(12) United States Patent
Zhu

(10) Patent No.: US 8,070,537 B2
(45) Date of Patent: Dec. 6, 2011

(54) PAD AND METHOD OF ASSEMBLY THE SAME TO CONNECTOR

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/850,053

(22) Filed: Aug. 4, 2010

(65) Prior Publication Data

US 2011/0034092 A1 Feb. 10, 2011

(30) Foreign Application Priority Data

Aug. 4, 2009 (CN) ..... 2009 1 0305141

(51) Int. Cl.
*H01R 9/24* (2006.01)

(52) U.S. Cl. ..... 439/885

(58) Field of Classification Search ..... 439/885, 439/884, 886, 83, 876, 733.1
See application file for complete search history.

(56) References Cited

U.S. PATENT DOCUMENTS 3,902,776 A * 9/1975 Williams et al. ..... 439/62
3,955,877 A * 5/1976 Cobaugh et al. ..... 439/853
4,270,829 A * 6/1981 Wilson ..... 439/83
4,616,416 A * 10/1986 Cabaud ..... 29/884
4,865,562 A * 9/1989 Burg et al. ..... 439/395
4,978,307 A * 12/1990 Billman et al. ..... 439/83
5,116,237 A * 5/1992 Loewen ..... 439/326
5,193,271 A * 3/1993 Kato ..... 29/885
5,376,026 A * 12/1994 Ohashi ..... 439/885
5,788,544 A * 8/1998 Drekmeier et al. ..... 439/885
5,848,920 A * 12/1998 Klein et al. ..... 439/885
5,938,039 A * 8/1999 Liu ..... 206/717
5,957,739 A * 9/1999 Bianca et al. ..... 439/885
6,139,377 A * 10/2000 Chen ..... 439/885
6,203,387 B1 * 3/2001 Daly et al. ..... 439/886
6,375,518 B2 * 4/2002 Sato ..... 439/701
6,406,338 B1 * 6/2002 Endo et al. ..... 439/885
6,431,878 B1 * 8/2002 Hirata et al. ..... 439/70
6,733,348 B2 * 5/2004 Howell et al. ..... 439/884
6,786,738 B2 * 9/2004 Lin ..... 439/71
6,857,916 B1 * 2/2005 Huang ..... 439/885
6,884,122 B2 * 4/2005 Robinson et al. ..... 439/722
6,908,313 B2 * 6/2005 Walkup et al. ..... 439/66
7,014,477 B2 * 3/2006 Tsai ..... 439/71
7,044,805 B1 * 5/2006 Huang ..... 439/676
7,168,964 B2 * 1/2007 Lemke et al. ..... 439/83
7,172,438 B2 * 2/2007 Vicich et al. ..... 439/83
7,377,795 B2 * 5/2008 Vicich et al. ..... 439/83
7,412,758 B1 * 8/2008 Costa ..... 29/11
7,494,389 B1 * 2/2009 Essert et al. ..... 439/884
7,744,430 B1 * 6/2010 Vrenna et al. ..... 439/733.1
2002/0098746 A1 * 7/2002 Costa ..... 439/885
2005/0009385 A1 * 1/2005 Korsunsky et al. ..... 439/83

(Continued)

*Primary Examiner* — Tulsidas C Patel
*Assistant Examiner* — Vladimir Imas
(74) *Attorney, Agent, or Firm* — Wei Te Chung; Andrew C. Cheng; Ming Chieh Chang

(57) ABSTRACT

A pad includes a retaining portion and a soldering portion. The retaining portion has a through hole running therethrough in a thickness direction of the metal sheet and four side edges perpendicular to the metal sheet. The soldering portion extends from a first side edge of the retaining portion. The whole of the pad is electroplated except two opposite third and forth side edges of the retaining portion which connect with opposite ends of the first side edge.

13 Claims, 3 Drawing Sheets

U.S. PATENT DOCUMENTS

2006/0199447 A1* 9/2006 Vicich et al. ..... 439/884
2008/0266685 A1* 10/2008 Byers et al. ..... 359/838
2009/0298348 A1* 12/2009 Lu et al. ..... 439/668
2010/0035488 A1* 2/2010 Zhang ..... 439/884
2010/0236815 A1* 9/2010 Seidler ..... 174/126.1
2011/0013280 A1* 1/2011 Byers et al. ..... 359/512

* cited by examiner

PAD AND METHOD OF ASSEMBLY THE SAME TO CONNECTOR

BACKGROUND OF THE INVENTION

1. Field of the Invention

The present invention relates to a pad and an assembly method of the pad into an insulating housing of an electrical connector to retain the electrical connector to a printed circuit board.

2. Description of the Related Art

Referring to FIG. 3 illustrating a traditional assembly method of a pad to an electrical connector, the assembly steps include: firstly, preparing a unity metallic strip and then stamping a pad strip 1' out of the unity metallic strip, the pad strip 1' including a scrapping portion 11' having a plurality of translating holes 111' and a plurality of pads 12' connecting with the scrapping portion 11', each pad 12' defining a connecting face 121' connecting with the scrapping portion 11', the scrapping portion 11' defining a plurality of connecting portions 112' connecting with the connecting faces 121', each connecting face 121' forming a pair of slight cutouts 122' at two sides of the connecting portion 112' so that the pads 12' are easy to be broken away from the scrapping portion 11'; secondly, electroplating the pad strip 1' to prevent the pads 12' from oxygenated, the step not be shown on the FIG. 3; thirdly, cutting the pad strip 1' into a plurality of independent pad strips 2' and each independent pad strip 2' just including a pad 12' and a part of the scrapping portion 11'; lastly, inserting the independent pad strip 2' into a receiving groove 31' of an insulative housing 3', and then cutting the scrapping portion 11' away from the pad 12', the connecting face 121' of the pad 12' forming a broken face 1211' which is not electroplated.

In view of the above, a new pad that overcomes the above-mentioned disadvantages is desired.

SUMMARY OF THE INVENTION

Accordingly, an object of the present invention is to provide a pad which not only can be easily assembled into an insulating housing of an electrical connector to retain the electrical connector to a printed circuit board but also is low cost.

To fulfill the above-mentioned object, a pad comprises a retaining portion and a soldering portion. The retaining portion has a through hole running therethrough in a thickness direction of the metal sheet and four side edges perpendicular to the metal sheet. The soldering portion extends from a first side edge of the retaining portion. The whole of the pad is electroplated except two opposite third and forth side edges of the retaining portion which connect with opposite ends of the first side edge.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
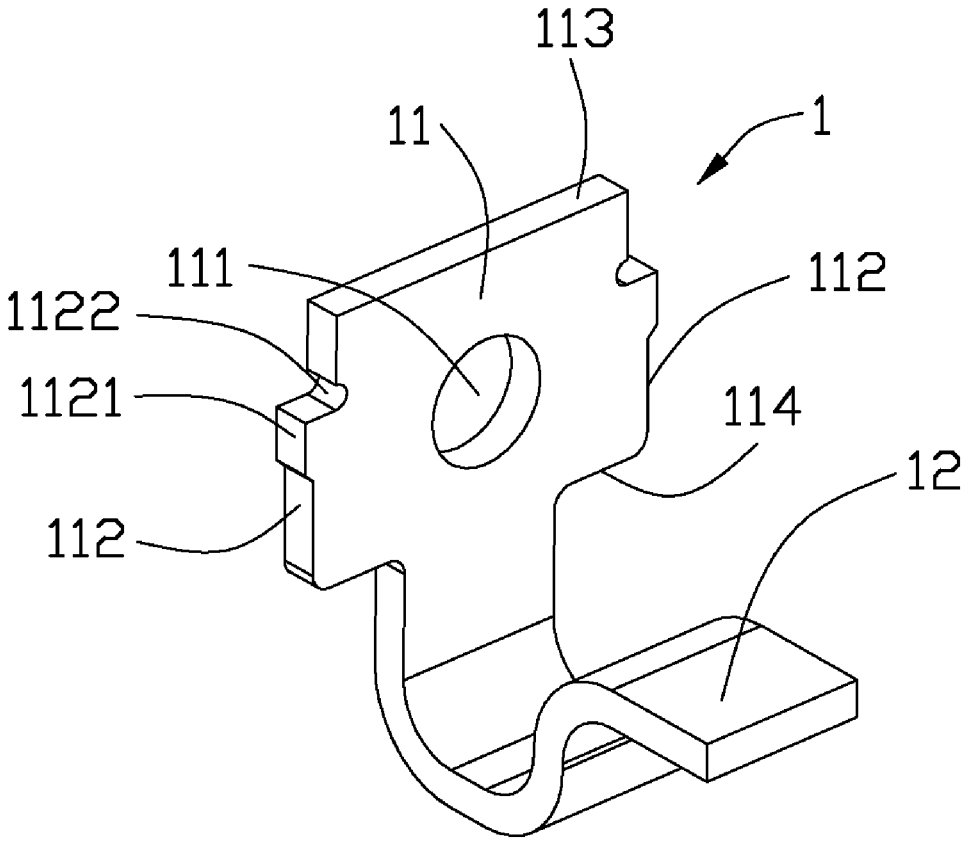
FIG. 1 is a perspective view of a pad of the present invention.

Referring to FIG. 1, a pad 1 made from a metal sheet includes a retaining portion 11 having a through hole 111 running therethrough in a thickness direction of the metal sheet and a soldering portion 12 welding to a PCB (not shown). The retaining portion 11 defines four side edges perpendicular to the metal sheet. The four side edges includes a pair of opposite first and second side edges 114, 113 and a pair of opposite third and fourth side edges 112 respectively connecting two ends of the first and second side edges 114, 113. The soldering portion 12 extends away from the first side edge 114 and then bends reversely. The soldering portion 12 extends perpendicular to the retaining portion 11. The second side edge 113 is of a straight line. The third and forth side edges 112 respectively have a barb 1121 projecting therefrom to and a recess 1122 is defined at a root of the barb 1121. The whole of the pad 1 is electroplated except two opposite third and forth side edges 112 of the retaining portion 11.

Figure 2:
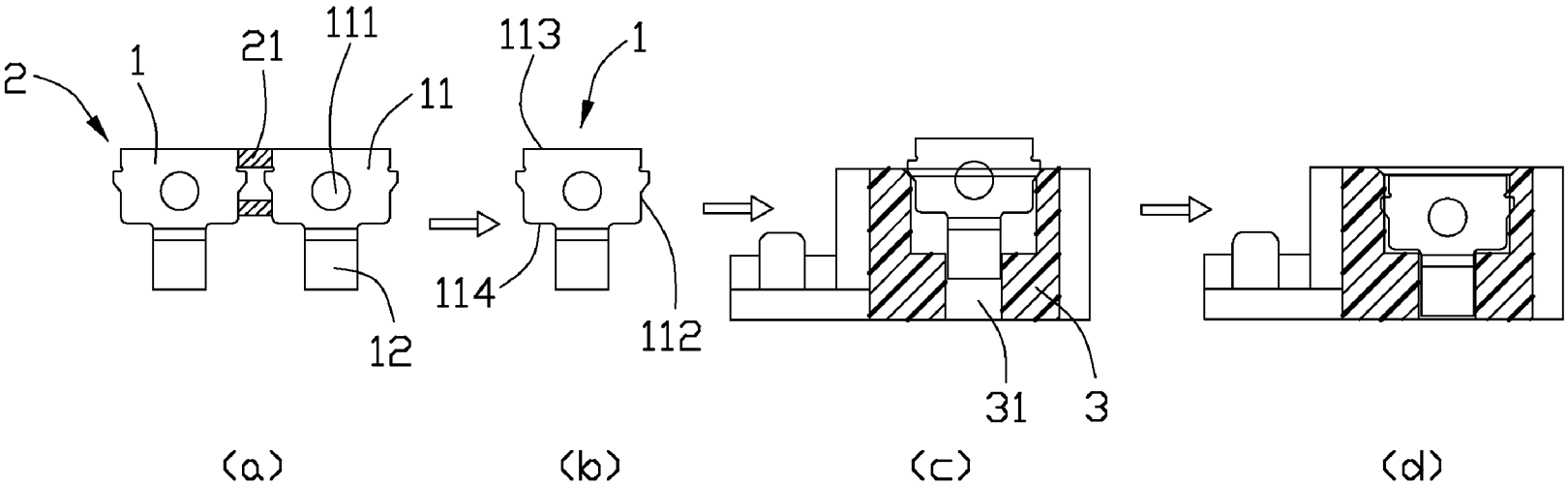
FIG. 2 is an illustrating view of an assembly method of the pad into an electrical connector.
Figure 3:
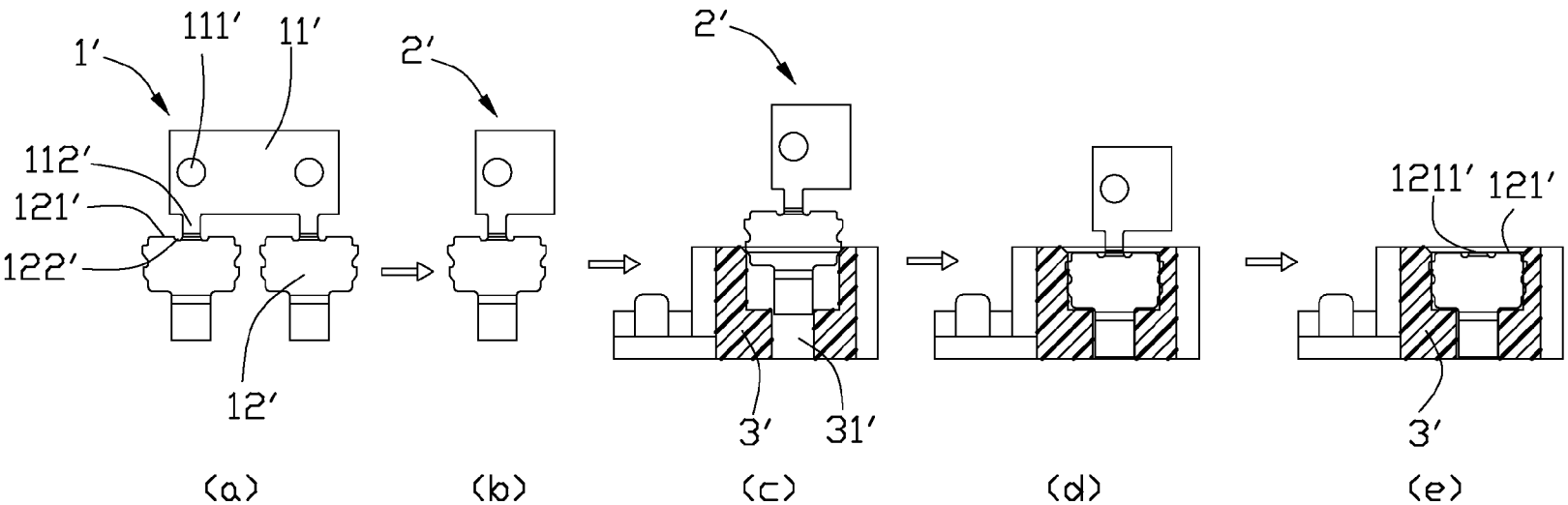
FIG. 3 is an illustrating view of a traditional assembly method of a pad into an electrical connector.

Referring to FIG. 2 showing an assembly method of making the pad 1. Firstly, preparing a unity metallic strip (not shown) and then stamping a plurality of pads 1 on the strip along an extending direction of the unity metallic strip to forming a stamping strip 2. The pads 1 integrally connect with each other by connecting portions 21 in the extending direction, wherein each pad 1 includes the retaining portion 11 and the soldering portion 12 extending from the retaining portion 11, the through holes 111 been as a translating holes and the stamping strip 2 is transported by the through holes 111. Secondly, electroplating the stamping strip 2 to prevent the pads 1 from oxygenated, the step not be shown on the FIG. 2, the whole stamping trip 2 is electroplated and please notes that the first and second side edges 113, 114 are covered with plated layer. Thirdly, cutting said one pad 1 from the stamping strip 2 and automobile transporting the pads 1 to a pre-determinated position which detects by the through holes 111 and then inserting the pads 1 to a receiving room 31 of an insulative housing 3. Please notes, the third and fourth side edges 112 at which the connecting portions 21 are disposed expose the metallic sheer material out without any plated layer since the cutting process is after the electroplating process. The material cost of the metallic sheet is lower since the larger scrapping portion of the conventional art is replaced with a smaller connecting portion 21.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pad made from a metal sheet, comprising:

a retaining portion having a through hole running therethrough in a thickness direction of the metal sheet, the retaining portion having opposite first and second edges and opposite third and fourth edges commonly perpendicular to the metal sheet;

a soldering portion extending from a first side edge of the retaining portion; wherein the whole of the pad is electroplated except two opposite third and forth side edges of the retaining portion which connect with opposite ends of the first side edge, said opposite third and forth side edges separates this pad from other pads in a same metal sheet by cutting.

2. The pad as claimed in claim 1, wherein a second side edge of the retaining portion is opposite to the first side edge and connects with one ends of the third and forth side edges, the second side edge is of a straight line.

3. The pad as claimed in claim 2, wherein the third and forth side edges respectively has a barb projecting therefrom to and a recess is defined at a root of the barb.

4. The pad as claimed in claim 3, wherein the soldering portion extends away from the first side edge and then bends reversely.

5. The pad as claimed in claim 1, wherein the soldering portion extends perpendicular to the retaining portion.

6. The pad as claimed in claim 1, wherein said first edge and said second edge are parallel to each other, and said third edge and said fourth edge are parallel to each other.

7. A mounting pad stamped from a metallic sheet for use with an electrical connector, comprising:

a planar retaining portion defining a through hole along a thickness direction and two opposite side edges; and a pair of barb structure formed on the two opposite side edges under condition that an upper region and a lower region of each of said side edges are respectively located, in a vertical direction perpendicular to said thickness direction, by two sides of the corresponding barb structure and originally, in temporary situation of a manufacturing process, connected, in a transverse direction perpendicular to both said thickness direction and said vertical direction, to a linking carrier structure which links the mounting pad and a neighboring mounting pad before the mounting pad is separated from a neighboring mounting pad; wherein an anti-oxygenation layer is plated upon the whole mounting pad except said upper region and the lower region of each of the side edges due to such plating occurring before the mounting pad is severed from the linking carrier structure.

8. The mounting pad as claimed in claim 7, wherein a soldering section unitarily extends from a bottom edge of the retaining portion.

9. The mounting pad as claimed in claim 8, wherein said soldering section is of a Z-shaped configuration.

10. The mounting pad as claimed in claim 7, wherein the linking carrier structure is dimensioned to be larger than the barbs in the transverse direction.

11. An electrical connector comprising:

an insulative housing with a receiving room therein;

a pad inserted into and retained in the receiving room, the pad comprising a plane retaining portion defining opposite two side edges with barbs thereon to interfere with the receiving room and a soldering portion extending from one of another opposite two side edges of the retaining portion;

a transmit hole completely defined in the retaining portion and located between said barbs.

12. The electrical connector as claimed in claim 11, wherein the other of said another two opposite side edge is hidden in the receiving room.

13. The electrical connector as claimed in claim 12, wherein the whole of the pad is electroplated except said opposite two side edges with barbs.

* * * * *